US007743586B2

(12) United States Patent
Hancock

(10) Patent No.: US 7,743,586 B2
(45) Date of Patent: Jun. 29, 2010

(54) MORTAR APPLYING MACHINE AND BLOCK FOR USE IN CONJUNCTION THEREWITH

(75) Inventor: Norman Hancock, St. Louis, MO (US)

(73) Assignee: Save Block, LLC, St. Louis, MO (US)

( * ) Notice: Subject to any disclaimer, the term of this patent is extended or adjusted under 35 U.S.C. 154(b) by 1428 days.

(21) Appl. No.: 11/136,974

(22) Filed: May 25, 2005

(65) Prior Publication Data

US 2005/0262800 A1 Dec. 1, 2005

Related U.S. Application Data

(60) Provisional application No. 60/574,808, filed on May 27, 2004.

(51) Int. Cl.
*B05C 5/00* (2006.01)

(52) U.S. Cl. ..... 52/749.13; 52/749.14; 222/611.2; 222/613; 222/614; 222/611.1; 222/618; 222/623; 222/625; 401/4; 401/5; 401/48; 401/193

(58) Field of Classification Search ..... 52/749.1, 52/749.12, 749.13, 749.14; 222/176, 240, 222/611.1, 618, 611.2, 613–614, 129, 386, 222/623, 625, 134, 163, 169, 190; 401/4, 401/5, 48, 193
See application file for complete search history.

(56) References Cited

U.S. PATENT DOCUMENTS 1,662,300 A * 3/1928 Covell ..... 52/603
2,683,981 A * 7/1954 Richey ..... 401/4
3,148,432 A * 9/1964 Garnett, Jr. ..... 425/62
3,355,849 A 12/1967 Hancock
3,527,940 A * 9/1970 Bernard et al. ..... 250/434
3,826,410 A * 7/1974 Meyer ..... 222/626
3,831,819 A * 8/1974 Bloom ..... 222/611.2
3,887,114 A * 6/1975 Villanovich ..... 222/612
3,936,989 A 2/1976 Hancock
4,126,979 A 11/1978 Hancock
5,035,352 A * 7/1991 Mania ..... 222/611.2

* cited by examiner

*Primary Examiner*—Jeanette Chapman
(74) *Attorney, Agent, or Firm*—Paul M. Denk

(57) ABSTRACT

A mortar applying machine incorporating housing, having a rotatable drive wheel mounted therein, the drive wheel adhered upon a pivot shaft located within the housing, and the drive wheel being disposed through the bottom of the housing for mortar and engagement with the surface of a row of blocks previously applied in the forming of a building wall. Fixedly mounted to the same shaft are a pair of paddles, formed of blades, which assure the proper shifting and movement of the fluid mortar into position within the housing, for passage out of its lower openings, and onto the transverse lands of the row of blocks as previously applied into the building wall. A diverter is provided within the housing to assure that the fluid mortar flows towards the front of the housing with respect to the direction of its movement when depositing a layer of mortar onto a previously laid row of blocks. A block is constructed to accommodate their usage in combination with this mortar applying machine, to provide motive power for processing and deposition of the fluid mortar, and at the same time provide transverse lands or surfaces onto which a thin layer of mortar may be applied, in preparation for the application of another row of blocks thereon, during the building of a wall.

8 Claims, 7 Drawing Sheets

MORTAR APPLYING MACHINE AND BLOCK FOR USE IN CONJUNCTION THEREWITH

CROSS REFERENCE TO RELATED APPLICATION

This nonprovisional patent application claims priority to the provisional patent application having Ser. No. 60/574,808, which was filed on May 27, 2004.

BACKGROUND OF THE INVENTION

This invention relates generally to a mortar applying machine, and to a particularly styled block that may be used in conjunction therewith, so that mortar may be uniformly and evenly applied to the specifically configured block, during their build-up, into the formation of a building or other wall.

A variety of blocks, bricks, and other construction members for use in assembling a wall are readily available in the art. In fact, the inventor herein has designed a variety of blocks of a wedgable configuration, where the blocks may be set up into the formation of a wall, generally of the mortarless configuration, for constructing buildings, or other walls, generally of an industrial or commercial nature. But, such blocks may also be fabricated into homes, preferably of the more marginal or lesser costs, and which may even have better applicability in the underdeveloped nations, where it is desired to provide lesser labor, and costs, in the assembly of residences for their citizens. For example, the U.S. patents, U.S. Pat. No. 3,936,999, U.S. Pat. No. 4,126,979, and U.S. Pat. No. 3,355,849 to the inventor herein, disclose particularly configured blocks, and which may even have some quantity of mortar applied thereto, during their assembly into a wall configuration.

The current invention, on the other hand, provides a particularly styled intermating type of block, which may have a thin layer of mortar uniformly applied thereon, at discreet locations upon the surface of each block, so that the wall can be quickly and easily assembled, and erected into the required height, eliminating the need for brick layers, or other skilled craftsmen in furnishing the laying of mortar, or tuck pointing, which normally elevates the costs of the building of homes commercial buildings, or the like, as known in the building trades.

SUMMARY OF THE INVENTION

This invention relates to a uniquely styled block and a mortar application machine for use in conjunction therewith, so as to provide uniform construction of a wall, with a minimum of effort, through the application of the mechanisms provided to facilitate the formation of a block wall, of the current design.

This invention contemplates the structure of a mortar application machine, which is designed to provide for the automatic dispensing of a uniform layer of mortar, to various blocks, and which mortar may be applied upon an entire length of a layer of previously applied blocks, at one or both side edges, to furnish a very quick and facile manner in which mortar may be applied, for the laying of another layer of blocks thereon, throughout the entire length of a wall, and with the performance of a single operation.

More specifically, the mortar applying machine comprises a mortar box, which has sufficient capacity to hold a significant quantity of premixed and fluidized mortar, and which can be delivered laterally, or to either side of the machine, and onto the front and back level surfaces of a layer of blocks as previously applied during the building of a wall structure. More specifically, the mortar applying machine incorporates a controller mechanism, which is designed for frictionally engaging a central portion of a layer of blocks previously applied, while the uniquely designed blocks have lands or flattened surfaces at both their front and back edges, and upon which the mortar machine may apply a layer of mortar, upon both of these surfaces, continuously, in providing for set up for the next subsequent application of another layer of blocks, thereon, and to assure their firm adherence, through the use of a layer of mortar therebetween. Hence, the machine itself significantly functions continuously to lay these layers of mortar, at the particular locations upon the previously laid layer of blocks, so that all the craftsman needs to do after the application of these parallel mortar layers, is to simply apply another layer of blocks thereon, for the purpose of erecting a building wall to the height specified in the construction plans. To assure that the mortar is continuously applied from the machine, the central and rotatable roller or drive wheel connects by a shaft, to either side of the housing. Also provided on the shaft at either side of the drive wheel are a pair of to paddle means, that are designed for mixing and assuring that mortar is delivered to the mortar delivery ports furnished downwardly of the machine housing, and to a width that just conveniently fits upon those block lands configured into the structure and design of the previously applied blocks, and to a thickness that assures uniformity of mortar joints, in the forming wall, during its fabrication.

Since the mortar applying machine of this invention may be used in either direction, to either apply mortar as it is shifted in one direction, or to apply the layers of mortar when the machine is shifted in an opposite direction, its housing includes a flow guide, in its upper region, so that as additional mortar is applied into the machine, as into the volumetric capacity of its housing, the guide may be oriented in one direction, or the other, to assure that the capacity of mortar delivered to the housing is oriented towards the front of the machine, as it is applied by the machine into a layered configuration upon the previously laid line of blocks, so that the mortar application process can proceed continuously, and uniformly, in its application of mortar to the blocks, during usage of the machine of this invention.

As can be readily understood, through usage of the mortar application machine of this invention, no longer will the bricklayer be required to perform the time and costly task of hand troweling mortar onto the previously laid block, but the machine automatically applies the same, in preparation for the simple laying of another row of blocks, thereon, as the building wall is erected to its required height.

It is, therefore, the principal object of this invention to provide a mortar applying machine that significantly reduces the amount of labor required when applying mortar, and building up blocks, into the fabrication of a wall of some specified height.

It is another object of this invention is to provide a mortar applying machine, incorporating a housing of some size, so that a full capacity of fluidized mortar may be applied therein, and uniformly deposited upon the layer of blocks previously set, to furnish a continuous method for the building of a wall, from the series of unique blocks of this current design.

Still another object of this invention is to provide a mortar applying machine that may be effectively and efficiently used when applying mortar in one or the other directions upon an erecting building wall.

Still another object of this invention is to provide a unique guide, within a mortar applying machine, to assure that the fluid mortar is directed towards that location within its housing to provide for a continuous flow of mortar onto the previously applied blocks, during the efficient and quick assembly of a wall, as during building construction.

These and other objects may become more apparent to those skilled in the art upon review of the summary of the invention as provided herein, and upon undertaking a study of the description of the preferred embodiment, in view of the drawings.

DESCRIPTION OF THE PREFERRED EMBODIMENT

Figure 1:
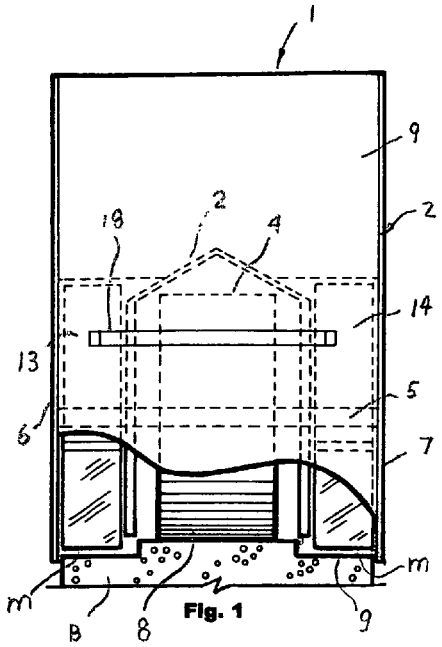
FIG. 1 is a front view of the mortar applying machine of this invention.
Figure 3:
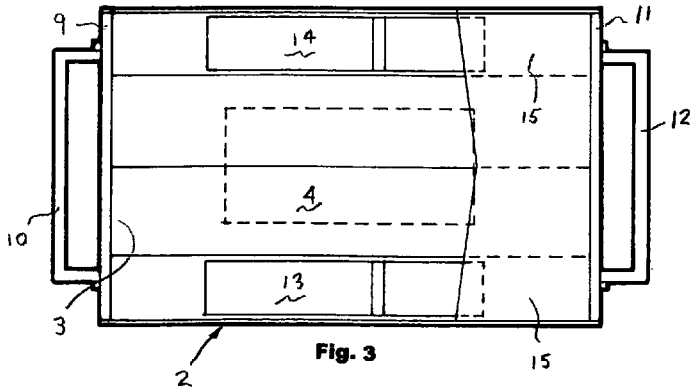
FIG. 3 is a top plane view thereof.
Figure 4:
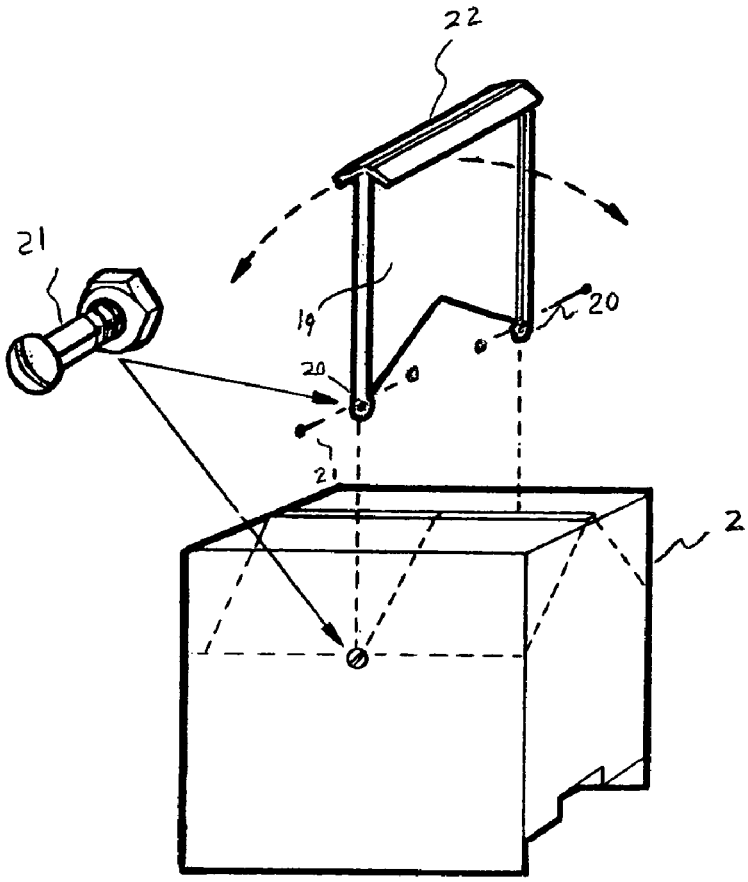
FIG. 4 is a partial exploded view of the housing for the mortar applying machine of this invention, showing its mortar flow guide elevated from within its housing.

In referring to the drawings, and in particular FIG. 1, the mortar applying machine 1 of this invention is readily disclosed. This is a front view of the machine, and it includes a housing 2, generally having an opened upper end, into which mortar may be deposited, the open top generally as can be seen at 3, in FIG. 3.

As can be also noted in FIG. 1, there is a drive wheel 4, securely mounted upon a shaft 5, the shaft being mounted to the opposing side walls 6 and 7 rotation within for the housing, as can be noted. The drive wheel 4 has a frictional surface, such as a rubberized type of surface 8, and which can contact the upper surface of the block, such as shown at B, to provide for turning of the drive wheel 4, during usage of the machine. As can also be seen, the front wall 9 of the housing has a handle 10, as does the rear wall 11 incorporates a handle 12 to facilitate the movement of the machine, during its usage in applying a thin layer of mortar, as can be seen at M, onto the upper lateral lands or surfaces S of the blocks therebelow, in preparation for the application of an additional row of concrete blocks thereon, during the erecting of a wall, as previously reviewed.

The shaft 5 also includes and securely mounts a pair of paddles, as at 13 and 14, where one is provided to either side of the drive wheel 4, and within the region of the location where mortar passes through the housing, for agitation and accumulation by means of the rotation of the said paddles, and for its exit out of the bottom openings, as at 15, and for deposition in a thin layer of mortar M, onto the lateral portions of the blocks B, as the mortar machine is pulled therealong, for depositing mortar onto the blocks below, in preparation for the application of a new layer of blocks, onto and upon the erecting wall.

Figure 2:
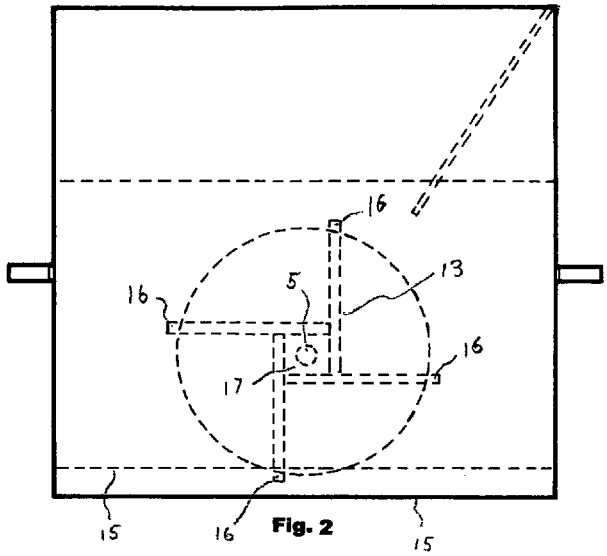
FIG. 2 is a side view of the machine.

The structure of the paddles 13 and 14 are more aptly disclosed in FIG. 2, where the paddles include a series of four, more or less, blades 16, secured around a center bearing 17, that securely mounts onto the shaft 5, as can be noted. The lateral location of the paddles 13 and 14, within the housing 2, is readily disclosed in FIG. 3.

Figure 5:
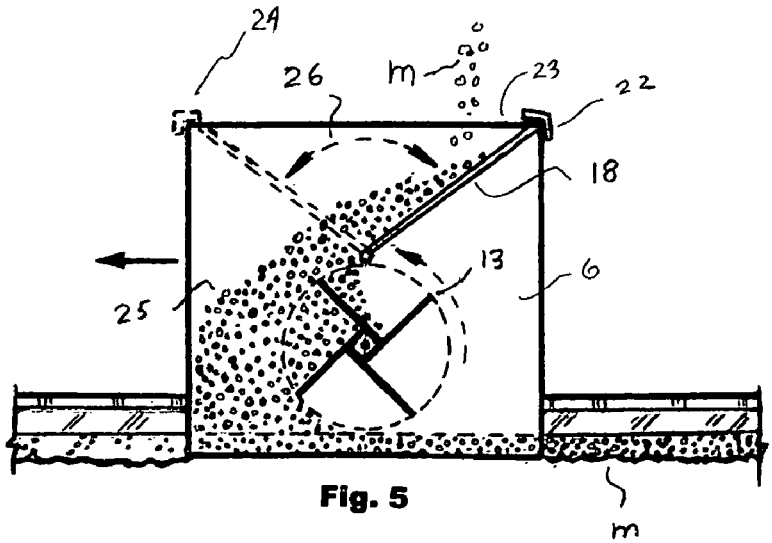
FIG. 5 shows the mortar applying machine, with a charge of mortar being applied therein, and the guide orienting the mortar towards the front of the machine as it moves to the left upon the row of previously applied blocks.

The paddle means are also provided for furnishing a convenient and directional delivery of mortar, as it is deposited into the housing 2, to insure that the mortar is directed towards either the front, or the back, of the housing, depending upon the directional movement of the machine, when applying mortar onto the layer of blocks therebelow. For example, as can be seen in FIG. 5, a mortar flow guide 18, which pivotally mounts to the two side walls 6 and 7 of the housing, is disclosed. The flow guide includes a plate 19, which at its lower lateral ends incorporates eyelets, as at 20, which provides for pivotal securement of the flow guide within the interior of the housing. Fasteners 21 are provided for this purpose. The upper edge of the flow guide includes a brace 22, which is designed for contacting either the back edge, as at 23, or the front edge, as at 24, of the housing, depending upon the direction of movement of the machine, during the application of the layers of mortar. As can be seen in FIG. 5, the guide, when set in that position, as shown, provides for diverting of the depositing mortar towards the front of the housing, as generally noted at 25 and its deposition downwardly onto the front of the paddles 13 or 14, so as to assure the flow of mortar towards the front of the housing, as the machine, in this particular figure, moves to the left, allowing for proper deposition of the fluid mortar downwardly through the housing bottom openings, during application of this mortar applying machine. As can also be seen, the flow guide can be pivoted, along the pivot path 26, to the front of the housing, when the mortar is being applied through movement of the machine to the right, or rearwardly, during its usage. Also the diverter **26*a*** diverts the mortar to either sides of the housing and into the influence of the paddles 13 and 14 during its depositing. (See FIG. 1).

Figure 10:
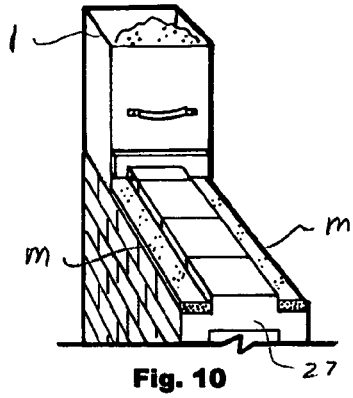
FIG. 10 shows the mortar applying machine, in use, for applying at both the front and back edges of the row of blocks therebelow, a uniform layer of mortar in preparation for application of another row of blocks thereon.
Figure 11:
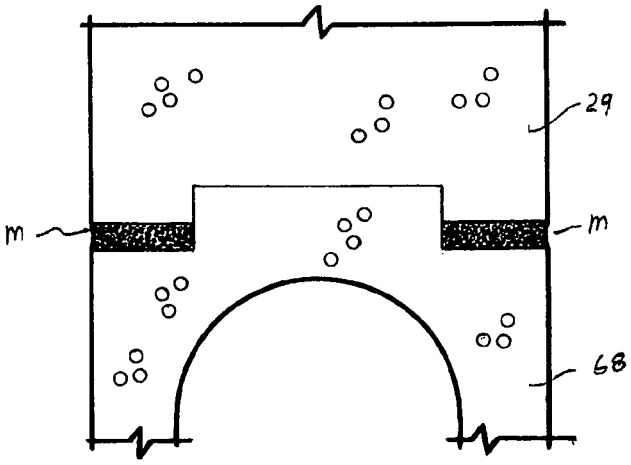
FIG. 11 shows the pressure configuration between a row of blocks, after the mortar has been applied, and an upper row of blocks has been applied thereon, for completing its mortar joint application to the row of blocks therebelow.

Hence, as can be readily understood, upon reviewing this machine, and its structure, it generally has a width equivalent to the width of the blocks upon which it is used to apply strips or layers of mortar, to either upper side edge of a previously applied row of blocks, thereby eliminating the need for the use of a skilled craftsman, to undertake such tasks. This can be generally seen in FIG. 10, where a previously applied layer of block or brick, as noted at 27, has a thin layer of mortar, as at M, applied to either upper side, through usage of the mortar applying machine 1, as can be noted. Thus, once applied, the mortar M will function as an adhesive between two layers of block, as can be noted in FIG. 11, a bottom layer 28 and an upper layer 29, with the pressure of the upper block 29 furnishing compactness upon the strips of mortar M, to assure proper adhesion.

Figure 9:
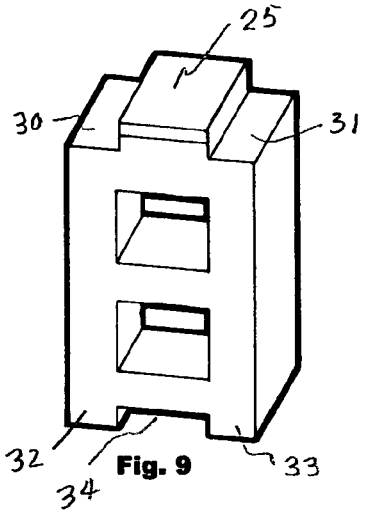
FIG. 9 is an isometric view of the block of this invention.
Figure 12:
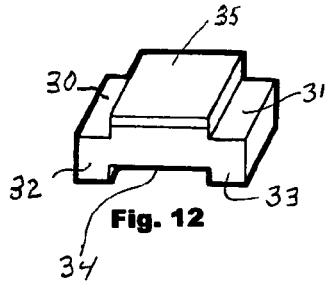
FIG. 12 shows a brick style block that can be used in conjunction with the mortar applying machine of this invention.

FIG. 9 shows an example of one style of block that may be utilized in conjunction with the mortar machine of this invention, for the building of a block wall. Or, as can be seen in FIG. 12, the brick may be of a lesser dimension, to form the brick style of wall, as can be understood. Nevertheless, the block or bricks are formed having upper lands 30 and 31, which are disposed for having a layer of mortar applied thereon, and which are intended to engage with or being contacted by the lower extensions 32 and 33 of a row of blocks applied thereon, during assembly of a wall. In addition, each of the blocks includes a lower groove 34, which is intended to mate with or upon the central upward extension 35 of a layer of blocks provided thereunder, to insure an interlocking engagement between each row of blocks, to further assure their retention together, in addition to the adhesion provided by the mortar joints therebetween, as formed through usage of the machine of this invention. This type of structure can be built into the block, of the type as shown in FIG. 9, or into the brick configuration, as disclosed in FIG. 12.

Figure 6:
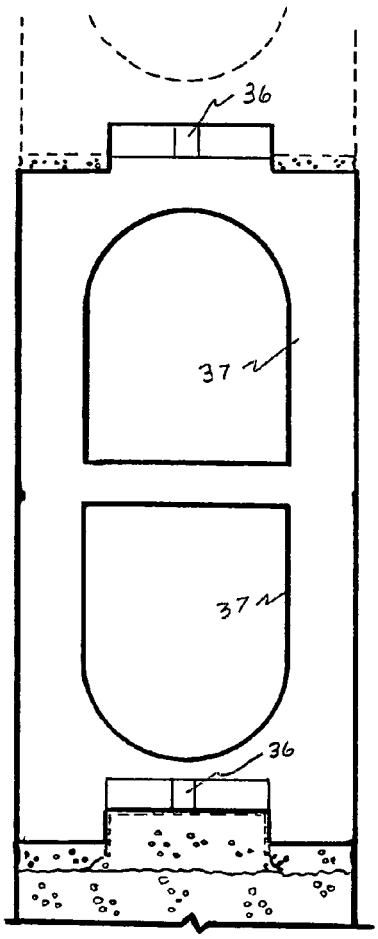
FIG. 6 provides an end view of the unique block of this invention, with the mortar joints being provided intermediate each row of the shown blocks.
Figure 7:
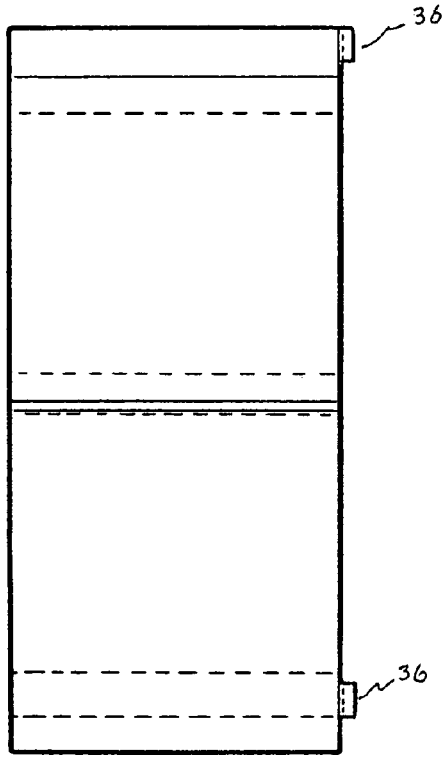
FIG. 7 is a side view of an applied row of blocks.
Figure 8:
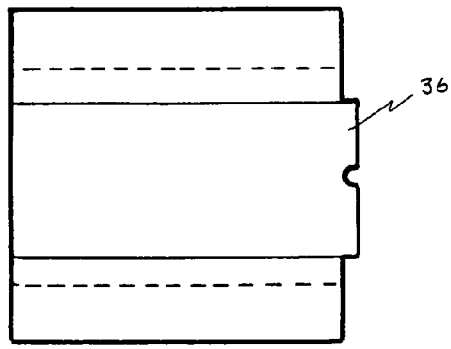
FIG. 8 is a top plane view of one of the blocks.

The more exact configuration of the block style of this construction product can be seen in FIGS. 6 thru 8. The only difference between the block as shown therein, and what has previously been described in FIG. 9, is that edge extensions, as at 36, may be provided at the ends of the block, as noted, for accommodating the locating of either utility conduits, or reinforcement rods, therethrough, as the block wall is being formed. Also, as can be obviously noted, various voids, as at 37, may be provided within the structured block, to provide for cost reduction in their manufacture, reasonably in the use of lesser materials. In addition, such may add to the insulation qualities for the formed blocks.

Figure 13:
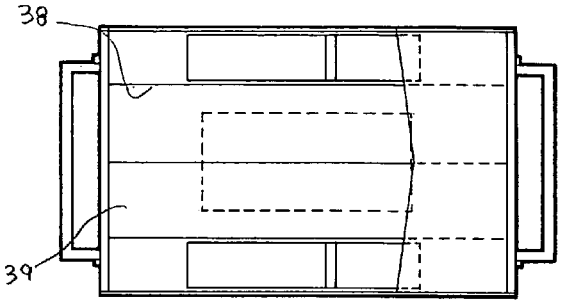
FIG. 13 is a top view of a revised mortar machine, showing two gates, for application of mortar to either side of the device.
Figure 14:
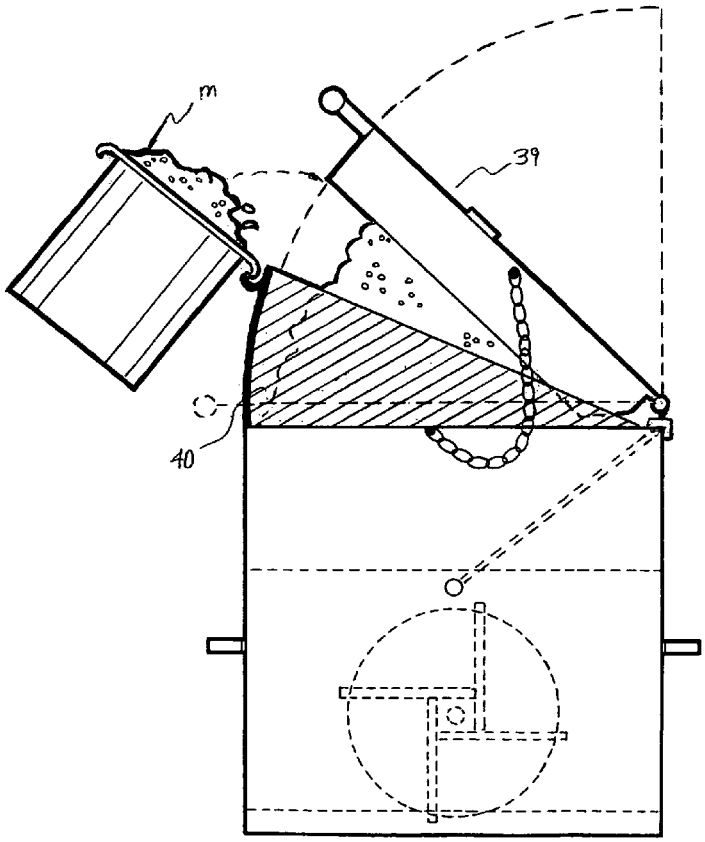
FIG. 14 is a side view thereof, showing a guard, having a support means, for mixing and application of mortar into the one or other side of the machine.
Figure 15:
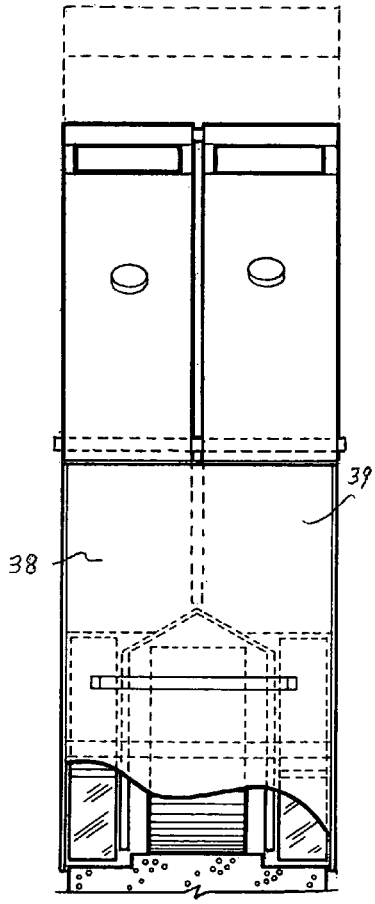
FIG. 15 is a front view thereof.

FIGS. 13 through 15 show the mortar machine having a pair of gates, at the upper end, so that mortar may be applied to one or the other side of the machine, during usage. The two gates are shown at 38 and 39. The raising of the gates, as can be seen in FIG. 14, at 39, shows a guard 40 with a bucket of mortar, as at M, being poured therein. This would be to one side of the machine. FIG. 15 shows a front view and discloses the two gates 38 and 39, at the top of the machine.

Figure 16:
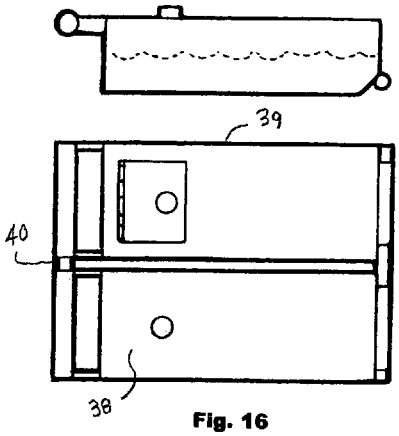
FIG. 16 is a top view of the mortar machine, of the dual gate modified type, with a means for engaging its lids onto the machine.
Figure 17:
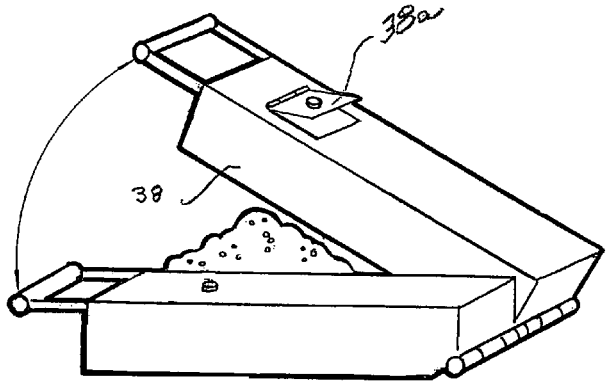
FIG. 17 is a perspective view of the machine, with the upper gates being opened.
Figure 18:
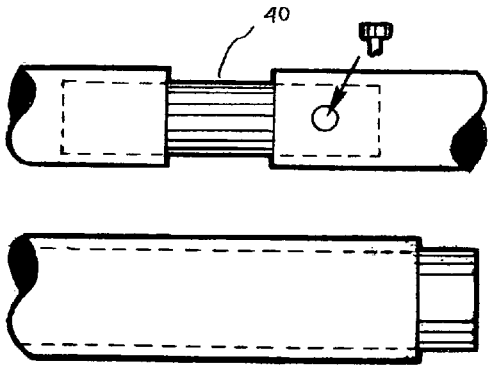
FIG. 18 shows a lock bolt for application for holding the two gates together for simultaneous movement.

FIGS. 16 and 17 show how the two gates, 38 and 39, lock together, as by means of a lock bolt 40 during its usage. In this manner, both gates can be open at the same time. Or, the lock bolt can be opened, and allow for the gates to be individually operated. FIG. 17 shows one of the gates, as at 38, and how it can be pivoted opened or closed, as can be seen. Each of the gates can include a door arrangement 38*a*, and through which water and sand can be added to the mix, in preparation for the mortar mix, within the machine, in readying the same for usage. FIG. 18 shows a lock bolt, as at 40, and how it can latch between the two gates, during usage.

Figure 19:
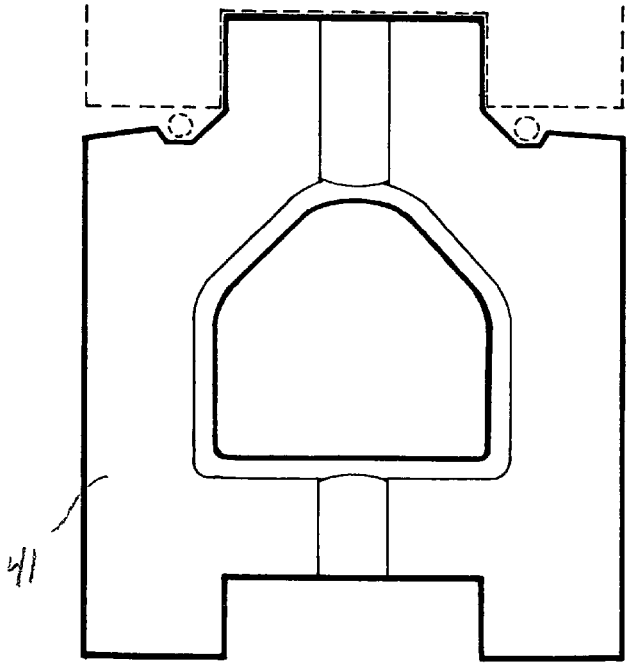
FIG. 19 shows an end view of a block set up into a wall, and having reinforcing rods extending the length, before the mortar machine applies a layer of mortar thereon in preparation for application of the next upper row of blocks.

FIG. 19 shows an end view of a block set 41, up into a wall, and having reinforcing rods extending the length, before the mortar machine applies a layer of mortar thereon in preparation for application of the next upper row of blocks.

Figure 20:
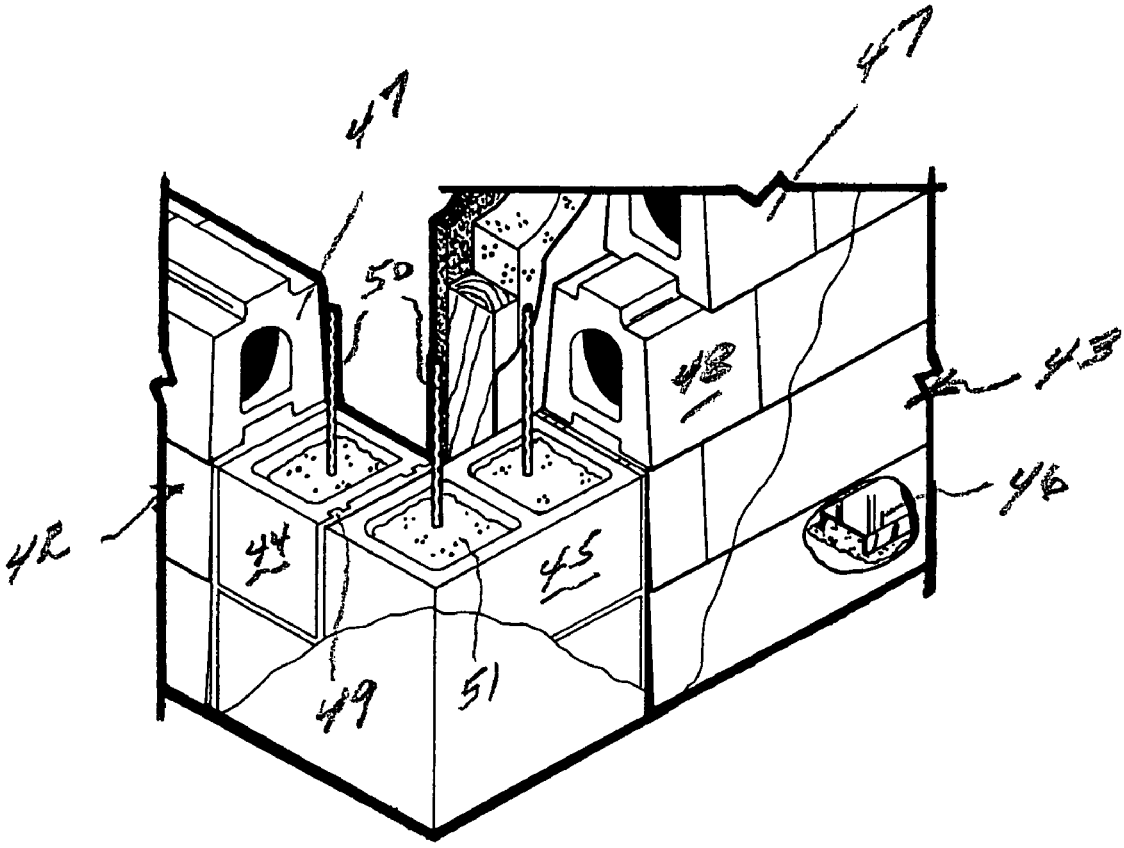
FIG. 20 shows the construction of a corner for the type of walls constructed utilizing the blocks and mortar applying machine of this invention.

FIG. 20 shows a pair of walls, and a corner, formed utilizing the blocks of this invention. And, in case a mortar mix is required, between blocks, the mortar applying machine of this invention would be used.

In this particular instance, though, the walls 42 and 43, join at a corner through the use of additional corner blocks, as noted at 44 and 45. Initially, the only mortar that is applied in the formation of this wall is the use of mortar filled channel, such a channel as shown at 46, that applies the initial or lowest layer of blocks into the wall structure. After that, in this particular embodiment, no further mortar is used with the interconnecting block system, as can be seen at 47 and 48, since the tongue and groove relationship between these blocks holds them firmly together. In addition, when these blocks are assembled, as mortarless connection, a sealant, something comparable to an oil base paint that includes an adhesive, and a viscoty agent, to make it a little more viscous, will be applied to the bottoms and the ends, in addition to the top, of each block, to allow the blocks, when set together, to seal, so as to prevent the migration of any moisture or air therethrough, once the wall is assembled. The corner of the wall is made up of its own unique style of block, as can be seen at 44 and 45, which incorporate various tongue and groove arrangements, as at 49, for securement of these blocks together. And, as can be noted, they may be reinforced, through the use of the reinforcing rods 50, and a concrete or mortar mix 51 may be applied therein, to affix the corner of the walls firmly in place, when establishing the walls 42 and 43, in a wall building project.

The sealant, as previously described, will include as an ingredient an adhesive or glue, to help hold the blocks together. In addition, to construct a wall of this nature of basically a mortarless concept, adds to the accelerated speed for erecting such a wall, since all that needs to be done is simply to brush on the seal, and to stack the blocks together. These blocks may be aligned, or staggered, for reinforcement purposes. Each block, with its tongue and groove arrangement, incorporates its own self alignment feature, to assure that the blocks are properly erected and set. Only the first or lowest layer of block needs to be plumbed, to make sure that it is properly horizontally arranged, and in proper angular alignment, and once that is done, the blocks may simply be set upon the mortared channel, to complete the first row.

Variations and modifications to the subject matter of this invention may occur to those skilled in the art upon review of the invention as described herein. Such variations, if within the spirit of this development, are intended to be encompassed within the scope of this invention as described. The description of the preferred embodiment, and its disclosure within the drawings, are set forth for illustrative purposes only.

The invention claimed is:

1. A mortar applying machine, for use in laying bricks and concrete blocks, said machine including a housing, said machine having a normally open upper end, and into which mortar mix and water is deposited, said housing having a pair of side walls, end walls, and partially opened bottom, a shaft extending between the side walls, a drive wheel provided generally centrally upon said shaft, said drive wheel at its lower reaches capable of riding upon any block to which mortar is to be applied, said shaft having a pair of paddles, mounted outwardly of said drive wheel, said paddles providing for mixing of the mortar mix into a flowable consistency and generally forcing it downwardly toward the lower opening laterally of said housing, for applying a specified thickness of mortar mix onto the block therebelow upon which the mortar applying machine moves upon its roller, when depositing a supply of mortar onto a block in preparation for the application of another block thereon; said machine including a pair of gates applied to the upper edge of one of the end walls of the housing, and each gate includes a door, and each door capable of pivoting open, when said doors are opened, allows for the addition of water and sand into the housing for mixing with a mortar mix in preparation for its application to a block there below, and said gate capable of pivoting into closure, and forcing the mixture downwardly into the housing to attain its mixing in preparation for its application to the upper surface of the block therebelow upon which the mortar applying machine moves.

2. The mortar applying machine of claim 1 and including at least one handle provided upon the housing to facilitate its shifting over the blocks when mixing and applying a deposit of mortar onto the lateral portions of the block therebelow.

3. The mortar applying machine of claim 2 wherein each end wall has one of said handles extending therefrom to facilitate their ease of grasping while moving of the mortar applying machine during its usage.

4. The mortar applying machine of claim 1 and including a flow glide plate, said plate being pivotally mounted to the side walls of the housing, and said plate capable of shifting to one end or the opposite end of the housing for directing the supply of mortar mix and water into the housing and into the direction of its panels to attain the mixing and application of mortar onto the block upon which the machine rides, to accommodate either forward or rearward movement of the mortar supplying machine during its usage.

5. The mortar applying machine of claim 1 and including a lock means interconnecting between each gate to provide for their simultaneous opening, or closing, to facilitate the addition of mortar mix into the housing to achieve its mixing.

6. The mortar applying machine of claim 5 and including each gate having a handle extending forwardly thereof, and the lock means interconnecting between each of the gate handles.

7. The mortar applying machine of claim 1, for use in laying bricks and concrete blocks, and wherein each concrete block having lateral shoulders provided at their upper edges, with a tongue provided between each shoulder, and each block having a hollow interior thereof.

8. The mortar applying machine of claim 7, wherein the machine provides for application of mortar to the shoulders of each block during assembly of a building wall.

* * * * *